United States Patent [19]

Gach

[11] Patent Number: 4,747,498

[45] Date of Patent: May 31, 1988

[54] SAFETY DISPENSING CLOSURE-CONTAINER PACKAGE

[75] Inventor: Peter P. Gach, Evansville, Ind.

[73] Assignee: Sunbeam Plastics Corporation, Evansville, Ind.

[21] Appl. No.: 26,206

[22] Filed: Mar. 16, 1987

Related U.S. Application Data

[63] Continuation-in-part of Ser. No. 879,487, Jun. 27, 1986, Pat. No. 4,682,702.

[51] Int. Cl.[4] ..... B65D 41/34

[52] U.S. Cl. ..... 215/232; 215/235; 215/250; 215/346; 220/258

[58] Field of Search ..... 215/232, 235, 250, 254, 215/330, 346; 220/258, 288, 304; 222/541, 556

[56] References Cited

U.S. PATENT DOCUMENTS

| | | | |
|---|---|---|---|
| 2,869,747 | 1/1959 | Patterson | 215/19 |
| 3,269,617 | 8/1966 | Goth | 222/541 |
| 3,434,620 | 3/1969 | Laurizio | 220/27 |
| 4,270,664 | 6/1981 | Buono | 215/216 |
| 4,356,939 | 11/1982 | Fitte | 222/541 |
| 4,461,394 | 7/1984 | Sendel et al. | 215/330 |
| 4,533,058 | 8/1985 | Uhlig | 214/235 |
| 4,558,794 | 12/1985 | Towns et al. | 215/250 |

FOREIGN PATENT DOCUMENTS

| | | | |
|---|---|---|---|
| 386270 | 4/1965 | Switzerland | 215/250 |

*Primary Examiner*—Donald F. Norton

*Attorney, Agent, or Firm*—Irvin L. Groh; Alfred L. Patmore, Jr.

[57] ABSTRACT

A threaded safety dispensing closure and container package in which the initial threading on of the closure to the product filled container affixes the closure to the container so that it cannot be removed, requiring dispensing through the dispensing orifice in the closure top and inhibiting refilling of the container. The container neck terminates in an annular end wall having a plurality of circumferentially spaced ratchet teeth which coact with the top of the closure cap allowing threading on but locking the cap to the container against unthreading removal. Tamper indication can be provided by an integrally molded insert across the dispensing orifice which is removed by a pull tab.

21 Claims, 2 Drawing Sheets

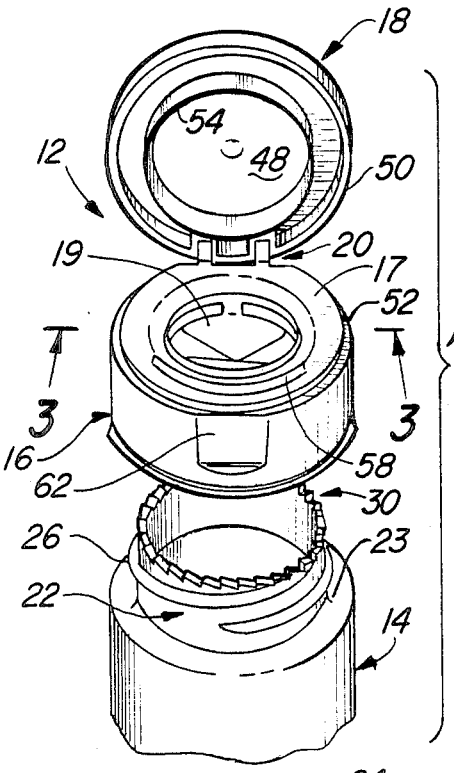
Fig-1
Fig-2
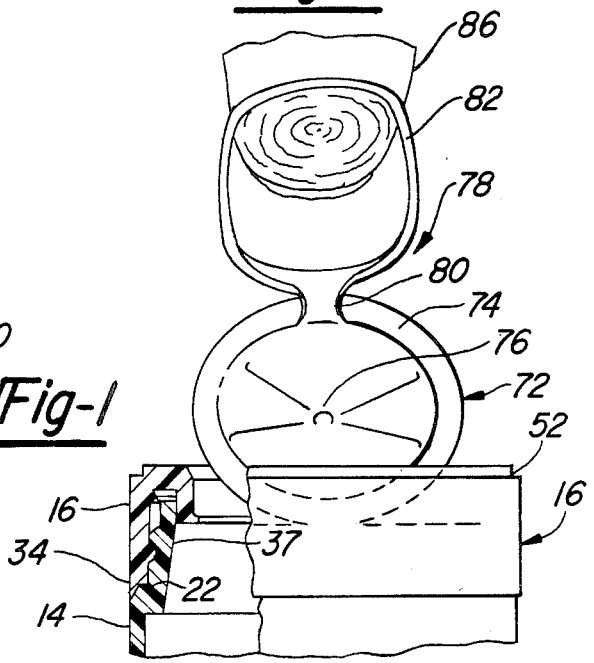
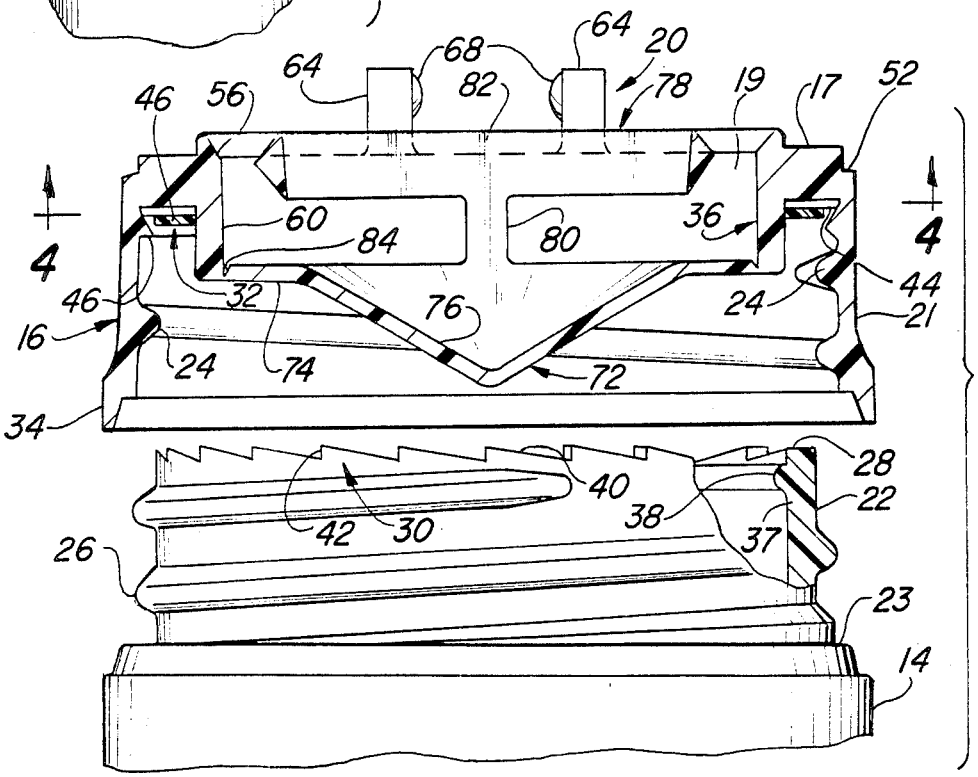
Fig-3

SAFETY DISPENSING CLOSURE-CONTAINER PACKAGE

This is a continuation-in-part of application Ser. No. 879,487 filed Jun. 27, 1986, now U.S. Pat. No 4,682,702.

This invention relates to a closure and container package, and, more particularly, to a safety dispensing closure and container package.

Safety closures or safety container-closure packages generally have a child-resistant or tamper indicating feature or both. The child resistant feature is designed to make it more difficult for a child to open the container as by requiring, for example, a combination of successive or simultaneous movements for opening or removing the closure from the container. The tamper indicating feature is designed to make a perspective purchaser aware that the container has been previously opened or tampered.

The present invention is directed to a dispensing package in which a safety feature affixes the closure to the container so that it cannot be removed, requiring dispensing through a dispensing orifice in the cap, and in some configurations making it difficult or impossible to refill the container. Making it difficult to refill the container is desirable where the original product is a chemical substance such as a cleaning agent or a drug which could harmfully contaminate another product introduced into the container.

A second safety feature can be provided in the present invention to indicate tampering. In one embodiment, evidence of an attempt to remove the closure from the container is provided. In another embodiment evidence is provided that the dispensing orifice has been opened providing access to the contents of the container.

The foregoing purposes of this invention have been accomplished in a dispensing closure and container package in which the container has a threaded neck which terminates in an annular end wall having a plurality of circumferentially spaced ratchet teeth. The closure includes a base cap, lid, and a hinge which connects the lid to the base cap. The base cap has a flat top with a dispensing orifice which is usually centrally located and is of a larger size for dispensing such solid materials as vitamin capsules and the like, or the orifice will be off center away from the hinge and of a smaller size for dispensing liquid products such as dishwashing detergents and the like. An annular outer skirt extends from the periphery of the top with internal threads complementary to the container threads. Engagement means is located in the annular area within the outer cap skirt for coaction with the container ratchet teeth so as to allow the base cap to be threaded onto the container neck but locking with the container ratchet teeth to prevent unthreading removal of the base cap from the container neck. An inner skirt concentric with the outer skirt extends from the cap top for sealing engagement with the container neck independently of the non-removal engagement of the container ratchet teeth with the base cap. The lid is moveable about the axis of the hinge from a closed position covering the orifice to an open dispensing position.

In one embodiment container ratchet teeth engage a plurality of circumferentially spaced ratchet teeth arranged in an annular pattern on the cap top within the cap skirt. There can be as few as two teeth on the base cap which engage two teeth on the container neck to prevent removal of the closure from the container. A typical pattern may contain four ratchet teeth on both the container neck and closure base cap equally spaced at 90°. A small number of teeth may have the appearance of projections on one of the members and corresponding indentations on the other member; however, they will be considered to simplify the claim language utilized herein as being engaging ratchet teeth on the two members.

The engaging means may further include a gasket which is interposed between the container ratchet teeth and base cap ratchet teeth. The gasket may further be of a resilient material which is compressed as the cap is threaded onto the container neck so that the teeth bite into the gasket when an attempt is made to unthread the base cap from the container neck. The gasket additionally may be of a material to form a bond between the container and base cap ratchet teeth to prevent unthreading removal of the cap from the container.

In some instances, the engagement means in the cap will not include ratchet teeth therein but use the gasket itself as the locking member between the container and cap. The gasket may be formed after the closure has been molded by pouring a hot melt material between the inner and outer skirts in contact with the base cap top. The hot melt material may be a plastisol which sets up to bond with the container ratchet teeth or act as a resilient material for the container ratchet teeth to engage. Ratchet teeth or radial ribs may be used to further retain the hot melt within the base cap. An inwardly directed flange adjacent the base cap top projecting inwardly from the outer skirt may be further used to confine the hot melt formation of the gasket or to retain a preformed gasket.

When ratchet teeth are used on the base cap as well as the container neck, usually an equally number of teeth will be utilized on both components. In some instances there may be a lesser number of teeth on one of the two components, and, usually, the container neck will have a standard, complete array of equally spaced ratchet teeth, and a smaller number of teeth may be used on the cap to act as fixed pawl engaging elements.

To further discourage an attempt to remove the closure base cap from the container, the container can be formed with a shoulder at the base of the neck and the base cap skirt can have a length so that the bottom of the outer skirt is brought into contact or close proximity with the container shoulder to prevent the insertion of a tool in an attempt to pry or remove the base cap from the container.

The base cap has an inner skirt or annular flange which is concentric with the outer skirt and extends from the cap top for sealing engagement with the container neck. The sealing engagement can be with the exterior or interior of the container neck and in most instances takes the form of a plug seal being in engagement with the inside of the container neck. The lid is moveable about the hinge from a closed position covering the dispensing orifice to an open dispensing position. Thus the primary safety function is accomplished by retention of the base cap on the container neck requiring the dispensing of the product through the orifice. The ratchet retention of the cap on the container neck is further enhanced by selecting the length of the outer cap skirt to bring the bottom of the skirt into close proximity with the container shoulder to discourage attempts to remove the cap. The sealing of the base cap to the container neck by the inner skirt is independent of the retention means also enhancing both the resealing and the retention.

A second tamper indicating safety function can be accomplished by reducing the wall thickness of the outer cap skirt adjacent to its bottom so that any attempt to remove the cap will damage or distort the bottom of the cap skirt providing visual evidence of the tampering.

Another safety feature providing tamper indication can be added in the form of a removable sealing disk which in integrally molded with and extends across the dispensing orifice. A pull tab is attached to the disk and a weakening groove is provided in the face of the disk so that the disk can be removed by lifting the pull tab away from the container. The initial package integrity can be checked by swinging the lid open and observing the condition or absence of the sealing disk.

The preferred embodiments of the invention are illustrated in the drawings in which:

FIG. 1 is an exploded perspective view of the closure-container package arranged for threading engagement of the base cap of the closure on the container neck and retention thereon by the container neck ratchet teeth;

FIG. 2 is an elevational view, partially in cross-section, showing the embodiment of FIG. 1 with the base cap firmly retained on the container neck, and with the closure lid removed for clarity to show the initial opening of the package by removal of an integrally molded insert which provides tamper indication;

FIG. 3 is a sectional elevational view along line 3—3 of FIG. 1 showing on an enlarged scale the details of the closure base cap and container with the lid removed for clarity;

Figure 4:
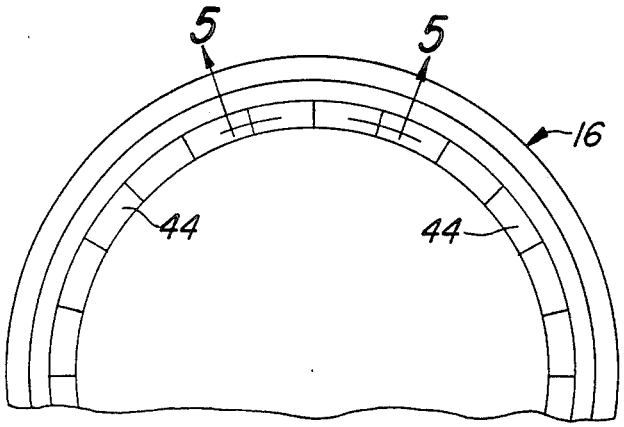
FIG. 4 is a partial plan view taken along line 4—4 of FIG. 3 showing a distribution of ratchet teeth on the base cap of the closure.
Figure 5:
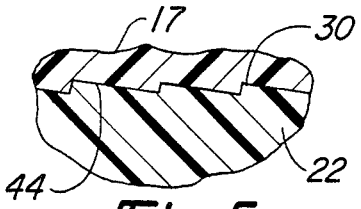
FIG. 5 is a partial sectional view taken along line 5—5 of FIG. 4 but with the container neck in engagement with the base cap.

Referring to FIGS. 1–3, package 10 is seen as including closure 12 and container 14. Closure 12 includes base cap 16 and cover lid 18 connected by a separable post and slot hinge 20. Base cap 16 has a flat top 17 with a dispensing orifice 19 therethrough in a depending cylindrical outer skirt 21 having internally molded threads 24. Container 14 has a neck 22 with a shoulder 23 at the base of the neck and complementary external threads 26 for engagement with cap threads 24. Container neck 22 terminates in an annular end wall 28 having a plurality of circumferentially spaced ratchet teeth 30 which engage the base cap at 32 when the closure has been fully threaded onto the container neck to prevent unthreading removal of the base cap from the container neck.

When the base cap 16 has been fully threaded onto container neck 22, the bottom of outer skirt 21 is in close proximity or contact with container shoulder 23 which prevents or discourages the use of a tool such as a knife or screw driver in an attempt to remove base cap 16 from container 14. The cap skirt 21 has a reduced wall thickness flange 34 at its bottom. Should an attempt be made to remove the cap 16 with a tool, flange 34 will be damaged or distorted providing evidence of tampering. Preferably, base cap 16 is molded with polypropylene providing a resilient structure with adequate thread retention characteristics for connection to the container, and any prying will distort or partially tear the flange 34. If a harder or more brittle material is used such as a high density polyethylene for greater thread retention, such prying will be evidenced by chipping or breaking off portions of flange 34.

Base cap 16 is provided with inner skirt or annular plug 36 for sealing engagement with the interior or exterior of container neck 22. Typically, this engagement would be with the interior surface 37 of neck 22 as shown in FIG. 3, and this sealing can be enhanced by sealing bead 38 projecting inwardly from the interior neck surface 37 adjacent to the neck end 28 as shown in FIG. 3.

Container ratchet teeth 30 have inclined cam surfaces 40 which permit threading on of the base cap 16 and stop surfaces 42 which engage the base cap 16 at 32 to prevent unthreading removal of the cap from the container neck. The cap engaging means at 32 can take the form of complementary ratchet teeth 44 arranged in an annular pattern on the cap top 17 between inner and outer skirts 36 and 21, as shown more clearly in FIGS. 4–9.

Figure 6:
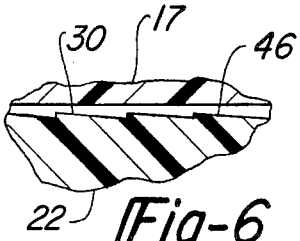
FIG. 6 is a partial cross sectional view similar to FIG. 5 showing another embodiment of the cap engagement with the container ratchet teeth.
Figure 7:
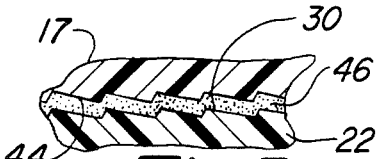
FIG. 7 is a partial cross sectional view similar to FIGS. 5 and 6 showing another embodiment of the engagement of the base cap to the container ratchet teeth.
Figure 9:
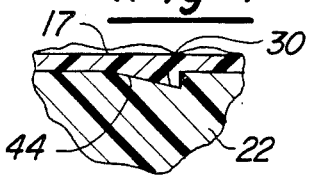
FIG. 9 is a partial cross sectional view along line 9—9 of FIG. 8 showing the ratchet engagement of the closure base cap with the container neck.

The engagement of container ratchet teeth 30 with the base cap 16 at 32 may be effected by inclusion of gasket 46 with cap ratchet teeth 44 as shown in FIG. 7 or without any cap ratchet teeth as shown in FIG. 6. Gasket 46 may be made of a resilient material to allow the ratchet teeth to bite into the gasket as it is compressed upon initial threading on of the cap and unthreading movement in an attempt to remove the cap. Gasket 46 may be a plastisol which adhears and bonds to the container ratchet teeth and the base cap. Gasket 46 may be formed after the closure 12 has been molded by pouring a hot melt material between the inner skirt 36 and outer skirt 21. Inwardly directed flange 46 projecting from outer skirt 21 can be used to contain such hot melt material.

Hinge 20 allows movement of the lid 18 from an open dispensing position as shown in FIG. 1 to a closed position covering the dispensing orifice 19. Lid or cover 18 has a flat top 48 and a depending skirt 50 which engages base cap rim or groove 52 for retention of the lid on the cap in its closed position presenting an aesthetically pleasing flush blending of the lid skirt 50 into the outer cap skirt 21. Dispensing orifice 19 is sealed when the lid 18 is in its closed position by an annular plug 54 depending from the flat lid top 48. A pouring lip 56 around the dispensing orifice 19 is established by an outwardly extending bevel, and this lip and upstanding circular or semi-circular guide lip 58, FIGS. 8 and 1, direct the lid plug 54 into the dispensing orifice 19. Sealing engagement of lid plug 54 in dispensing orifice 19 also retains the lid 18 on the base cap 16 in its closed position independent of the coaction of skirt 50 with rim 52.

The interior 60 of inner skirt 36 serves as a nozzle extension of the dispensing orifice 19 and provides a coacting sealing surface with lid plug 54. Outer cap skirt 21 can be provided with an indentation 62 for finger access to push lid 18 open.

Figure 10:
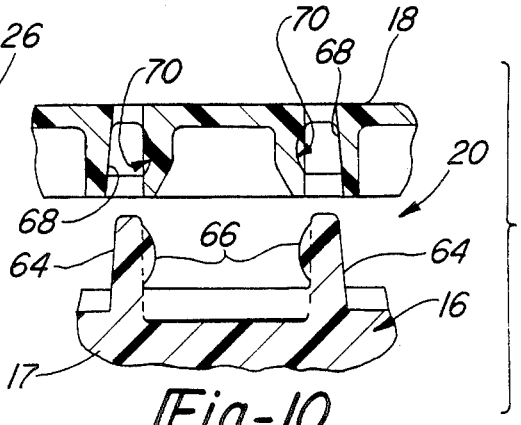
FIG. 10 is a cross sectional enlargement taken though the hinge structure showing the means of assembly of the closure lid to the base cap.

Post and slot hinge 20 not only provides easy separation of the lid 18 and cap 16 and the advantage of forming the lid and cap separately with less complex molds which additionally allows the use of different materials and color combinations between the lid and cap, but also provides a hinge which is hidden in a closed condition to further enhance the aesthetic appearance of the package. This hinge structure, as shown in FIG. 10, includes a pair of spaced apart posts 64 which project upwardly from cap top 17 or from the hinge area enlargement of cap groove or recess 52. Posts 64 are provided with curvilinear projections 66 which are in-line with each other and the centers of which establish a hinge axis. The lid 18 is provided with a wall structure defining a pair of complementary slots 68, and each slot has a complementary aligned curvilinear indentation 70. The lid slots and curvilinear indentations receive the cap posts and mating curvilinear projections establishing the working hinge 20. The curvilinear projections 66 can take a semi-spherical shape or other shape such as a cylindrical shape so long as they provide complete swinging action with the corresponding indentations 70. Likewise, the projections can be facing each other as shown in FIG. 10, or they may be facing away from each other, or even on one side on one post and the other side on the other post so long as they are on a common pivotal axis. It should also be noted that the posts can be located on the lid and the slots be located on the base cap to perform the same equivalent function. The foregoing hinge structure is set forth in more detail in co-pending U.S. patent application, Ser. No. 825,464 filed Feb. 3, 1986 now U.S. Pat. No. 4,066,062.

It should be appreciated that while safety package 10 with its ratchet retention is shown with a wide mouth dispensing orifice 19, the same principals can be used with a smaller, usually off center, dispensing orifice or nozzle which is more appropriate for the use in dispensing liquids such as liquid dishwashing detergents.

Figure 8:
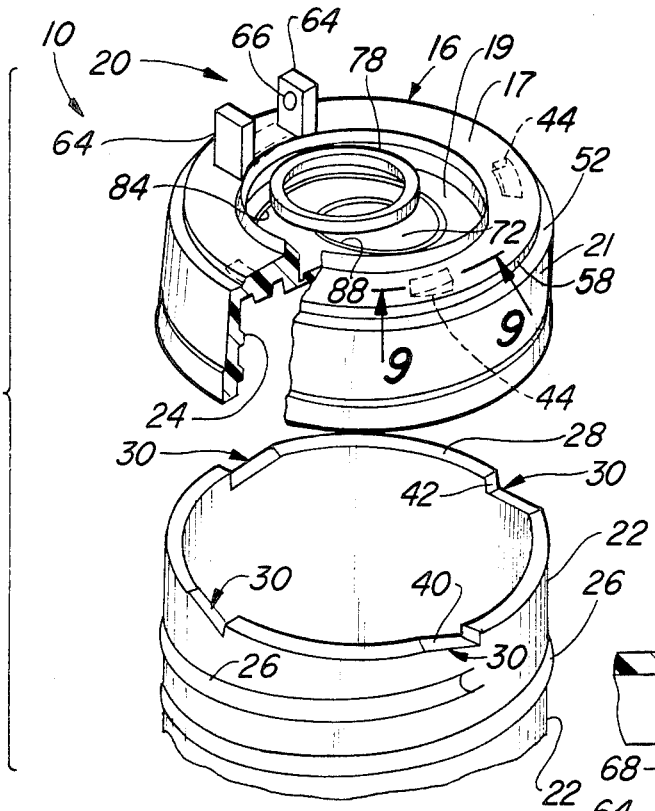
FIG. 8 is an exploded perspective view of another embodiment of the closure-container package of this invention arranged for threaded engagment of the closure base cap to the container and retention thereon by ratchet teeth similar to the embodiment of FIGS. 1–3, but showing an alternative safety sealing diaphragm or disk for tamper indication.

To provide virtual hermetic sealing of the package and to provide a tamper indicator, removable sealing disk 72 can be molded integrally with the base cap 16 extending over the dispensing orifice 19. In the illustrated embodiments sealing disk 72 is located adjacent to the bottom of inner skirt 36 projecting inwardly from the interior wall surface 60. In the embodiment of FIGS. 1–3, sealing disk or membrane 72 is formed with a flat annular portion 74 the outside of which is contiguous with and joined to the internal wall 60 of skirt 36. The disk 72 further includes a central conical section 76 which extends from the annular portion 74 downwardly into container neck 22. Pull tab 78 is attached to sealing disk 72 as by a post 80 which is attached at one end to the annular portion 74 of sealing disk 72 with the other end of the post being formed with a finger pull ring 82. A weakening groove 84 is molded in the face of disk 72 to provide a frangible break area when the pull ring 82 is lifted by the users finger 86 as shown in FIG. 2. In the embodiments of FIGS. 1–3, this weakening groove 84 is contiguous with the periphery of the orifice 19 or the inner wall 60 of inner skirt 36. The conical central portion 76 of the disk provides structural rigidity so that a clean tear or break occurs when the ring 82 is lifted. In the embodiment of FIG. 8, the sealing disk 72 is shown as a planar disk across the dispensing orifice 19 and an additional groove 88 forms an overall spiral groove 84, 88 so that as the finger pull tab 70 is lifted, the sealing disk is first removed as a spiral strip as more fully described in my co-pending U.S. application, Ser. No. 879,487, filed Jun. 27, 1986, now U.S. Pat. No. 4,682,702.

The embodiments of the invention in which an exclusive property or privilege is claimed are defined as follows:

1. A safety dispensing closure and container package comprising, in combination: a container having a threaded neck terminating in an annular end wall having a plurality of circumferentially spaced ratchet teeth; a closure including a base cap, lid and a hinge connecting said lid to said base cap; said base cap having a flat top with a dispensing orifice therethrough and an annular outer skirt extending from the periphery of said top with internal threads complementary to said container threads; a plurality of circumferentially spaced ratchet teeth arranged in an annular pattern on said cap top within said outer cap skirt for coaction with said container ratchet teeth, allowing said base cap to be threaded onto said container neck, but locking with said container ratchet teeth to prevent unthreading removal of said base cap from said container neck; an inner skirt concentric with said outer skirt extending from said cap top for sealing engagement with said container neck; and said lid being movable about said hinge from a closed position covering said orifice to an open dispensing position.

2. The safety dispensing package of claim 1 wherein at least two teeth on said cap top are in engagement with two teeth on said container neck preventing disengagement of said base cap from said container when unthreading torque is applied.

3. The safety dispensing package of claim 1 further including a gasket interposed between said container and base cap ratchet teeth.

4. The safety dispensing package of claim 3 wherein said gasket is resilient and is compressed as said cap is threaded onto said container neck and wherein said container and base cap ratchet teeth bite into said gasket when an attempt is made to unthread said base cap from said container neck.

5. The safety dispensing package of claim 3 wherein said gasket forms a bond with said container and base cap ratchet teeth to prevent unthreading removal of said cap from said container.

6. The safety dispensing package of claim 1 wherein there is an equal number of ratchet teeth on said container neck and said base cap arranged with equal circumferential spacing.

7. The safety dispensing package of claim 1 wherein said container has a shoulder at the base of said neck and said outer skirt has a length that when said base cap is threaded onto said container neck, the bottom of said outer skirt will be in such close proximity to said shoulder so as to prevent the insertion of a tool in an attempt to remove said base cap from said container.

8. The safety dispensing package of claim 7 wherein said outer cap skirt has a reduced wall thickness below said internal threads to the bottom thereof whereby any attempt to remove said base cap from said container by prying between the bottom of said cap skirt and said container shoulder will distort the bottom of said cap skirt providing evidence of tampering.

9. The safety dispensing package of claim 1 wherein said inner skirt is in the form of an annular plug, the exterior of which sealingly engages the inside of said container neck.

10. The safety dispensing package of claim 7 wherein the interior of said annular plug forms a nozzle extension of said dispensing orifice.

11. The safety dispensing package of claim 9 wherein said container neck has an internal bead adjacent said ratchet teeth which sealingly engages with said annular plug.

12. The safety dispensing package of claim 1 further including a cylindrical plug extending from said lid for sealing engagement with said dispensing orifice when said lid is in its closed position.

13. The safety dispensing package of claim 1 further including a removable sealing disk integrally molded with and extending across said dispensing orifice; a weakening groove in the face of said disk adjacent the periphery of said orifice; and a pull tab attached to said disk on the inner side of said groove; whereby said sealing disk can be removed by gripping said pull tab and lifting it away from said container, and the initial package integrity can be checked by swinging said lid open and observing the condition or absence of said sealing disk.

14. The safety dispensing package of claim 13 wherein said pull tab is formed as a post, one end of which is attached to said disk and the other end of which is attached to a finger pull ring and further including an annular plug extending from the lid for sealing engagement with said dispensing orifice and confining said post and pull ring when said lid is in its closed position.

15. The safety dispensing package of claim 13 wherein the weakening groove in said disk is contiguous with the periphery of said orifice and wherein said disk is formed with a flat annular portion, the outside of which is contiguous with said groove, and in which said pull tab is attached, said disk further including a central conical section extending from said annular portion with its apex extending into the container neck, thereby stiffening said disk and providing easy fracture at said weakening groove when said pull tab is lifted for removal of said disk.

16. A safety dispensing closure and container package comprising, in combination: a container having a threaded neck terminating in an annular end wall having a plurality of circumferentially spaced ratchet teeth; a closure including a base cap, a lid, and a hinge connecting said lid to said base cap; said base cap having a flat top with a dispensing orifice therethrough and an annular outer skirt extending from the periphery of said top with internal threads complementary to said container threads; a plurality of circumferentially spaced ratchet teeth arranged in an annular pattern on said cap top within said cap skirt for engagement with said container ratchet teeth, said cap and container ratchet teeth passing over each other as said base cap is threaded onto said container neck but locking together to prevent unthreading removal of said base cap from said container neck; an annular plug concentric with said outer skirt extending from said cap top for sealing engagement with said container neck; and said lid being movable about said hinge from a closed position covering said orifice to an open dispensing position.

17. A safety dispensing closure and container package comprising, in combination: a container having a threaded neck with a shoulder at the base of the neck and terminating at its free end in an annular end wall having a plurality of circumferentially spaced ratchet teeth; a closure including a base cap, a lid, and a hinge connecting said lid to said base cap, said base cap having a flat top with a dispensing orifice therethrough and an annular outer skirt extending from the periphery of said top with internal threads complementary to said container threads; a plurality of circumferentially spaced ratchet teeth arranged in an annular pattern on said cap top within said cap skirt for engagement with said container ratchet teeth, said cap and container ratchet teeth passing over each other as said base cap is threaded onto said container neck but locking together to prevent unthreading removal of said base cap from said container neck; said outer skirt having a length such that when said base cap is threaded onto said container neck, the bottom of said outer skirt will be in such close proximity to said shoulder so as to prevent the insertion of a tool in an attempt to remove said base cap from said container, an inner skirt concentric with said outer skirt extending from said cap top for sealing engagement with said container neck; and said lid being movable about said hinge from a closed position covering said orifice to an open dispensing position.

18. The safety dispensing package of claim 17 further including a removable sealing disk integrally molded with and extending across said dispensing orifice; a weakening groove in the face of said disk adjacent the periphery of said orifice; and a pull tab attached to said disk on the inner side of said groove; whereby said sealing disk can be removed by gripping said pull tab and lifting it away from said container, and the initial package integrity can be checked by swinging said lid open and observing the condition or absence of said sealing disk.

19. A safety dispensing closure and container package comprising, in combination: a container having a threaded neck terminating in an annular end wall having a plurality of circumferentially spaced ratchet teeth; a closure including a base cap, lid and a hinge connecting said lid to said base cap; said base cap having a flat top with a dispensing orifice therethrough and an annular outer skirt extending from the periphery of said top with internal threads complementary to said container threads; a gasket located in an annular area within said outer cap skirt for coaction with said container ratchet teeth, allowing said base cap to be threaded onto said container neck, but locking with said container ratchet teeth to prevent unthreading removal of said base cap from said container neck; an inner skirt concentric with said outerskirt extending from said cap top for sealing engagement with said container neck; and said lid being movable about said hinge from a closed position covering said orifice to an open dispensing position.

20. The safety dispensing package of claim 19 wherein said gasket is formed after said closure has been molded by pouring a hot melt material between said inner and outer skirts in contact with said base cap top.

21. A safety dispensing closure and container package comprising, in combination: a container having a threaded neck terminating in an annular end wall having a plurality of circumferentially spaced ratchet teeth; a closure including a base cap, lid and a hinge connecting said lid to said base cap wherein said hinge is a spaced post and slot hinge permitting separate molding of said base cap and lid and assembly together at said hinge; said base cap having a flat top with a dispensing orifice therethrough and an annular outer skirt extending from the periphery of said top with internal threads complementary to said container threads; engagement means located in an annular area within said outer cap for coaction with said container ratchet teeth, allowing said base cap to be threaded onto said container neck, but locking with said container ratchet teeth to prevent unthreading removal of said base cap from said container neck; an inner skirt concentric with said outer skirt extending from said cap top for sealing engagement with said container neck; and said lid being movable about said hinge from a closed position covering said orifice to an open dispensing position.

* * * * *